US009770059B2

(12) United States Patent
Reese et al.

(10) Patent No.: US 9,770,059 B2
(45) Date of Patent: Sep. 26, 2017

(54) ADJUSTABLY SIZED MEDICAL GOWN

(71) Applicant: Prestige Ameritech, Ltd., North Richland Hills, TX (US)

(72) Inventors: George Daniel Reese, North Richland Hills, TX (US); Donna L. Reese, North Richland Hills, TX (US)

(73) Assignee: Prestige Ameritech, Ltd., North Richland Hills, TX (US)

( * ) Notice: Subject to any disclaimer, the term of this patent is extended or adjusted under 35 U.S.C. 154(b) by 35 days.

(21) Appl. No.: 14/726,487

(22) Filed: May 30, 2015

(65) Prior Publication Data

US 2016/0345644 A1 Dec. 1, 2016

(51) Int. Cl.
*A41D 13/12* (2006.01)

(52) U.S. Cl.
CPC ..... *A41D 13/1209* (2013.01); *A41D 13/129* (2013.01)

(58) Field of Classification Search
CPC ..... A41B 13/10; A41B 13/12; A41B 13/1236; A41B 13/1209; A41D 15/00
USPC ..... 2/69, 114, 48
See application file for complete search history.

(56) References Cited

U.S. PATENT DOCUMENTS 4,075,716 A 2/1978 Collins
4,608,719 A * 9/1986 Lunt ..... A41D 13/1209 2/114
4,736,467 A * 4/1988 Schwarze ..... A41D 13/1209 2/114
4,951,318 A * 8/1990 Harreld ..... A41D 13/1209 2/48
5,444,873 A * 8/1995 Levin ..... A41D 13/1236 2/114
D533,982 S 12/2006 Graneto, III
D598,638 S * 8/2009 Graneto, III ..... D2/720
7,971,274 B2 * 7/2011 Graneto, III ..... A41D 13/1209 2/114
2007/0028343 A1 * 2/2007 Makowka ..... A41D 13/00 2/48
2012/0117708 A1 * 5/2012 Trapani ..... A41D 13/1209 2/83
2013/0089691 A1 * 4/2013 Mazursky ..... A41B 13/10 428/43

(Continued)

*Primary Examiner* — Shaun R Hurley
*Assistant Examiner* — Bao-Thieu L Nguyen
(74) *Attorney, Agent, or Firm* — BKDowd Law, PC; Betsy Kingsbury Dowd

(57) ABSTRACT

A medical gown includes a self-adjusting strap(s) that expands an upper torso section beyond a nominal girth thereof, for an adjustable fit. An upper and lower self-adjusting strap may be provided across the back. The straps may be formed from perforations in the upper torso section. A portion of the gown breaks away along the perforations to form the straps in response to stress or pulling when donned or during use. The self-adjusting straps allow expansion of the upper torso section to conform to users who require larger than the nominal girth, while continuing to secure the medical gown on the wearer during use. Extendable tie straps may be included, which are unfolded and elongated for adjustably sizing the closure around the wearer's waist. The tie straps may be sufficiently long to extend to the back, and back around the waist again for tying in the front of the gown.

21 Claims, 9 Drawing Sheets

(56) References Cited

U.S. PATENT DOCUMENTS

| | | | | |
|---|---|---|---|---|
| 2013/0191960 | A1* | 8/2013 | Pasko | A41D 13/12 2/114 |
| 2013/0283496 | A1* | 10/2013 | Pasko | A41D 13/12 2/114 |
| 2013/0318682 | A1* | 12/2013 | Graneto, III | A41D 13/1236 2/114 |
| 2014/0271755 | A1* | 9/2014 | Busch | A01N 59/00 424/404 |
| 2015/0208741 | A1* | 7/2015 | Pasko | A41D 13/12 2/114 |
| 2016/0066631 | A1* | 3/2016 | Pasko | A41D 13/12 2/114 |

* cited by examiner

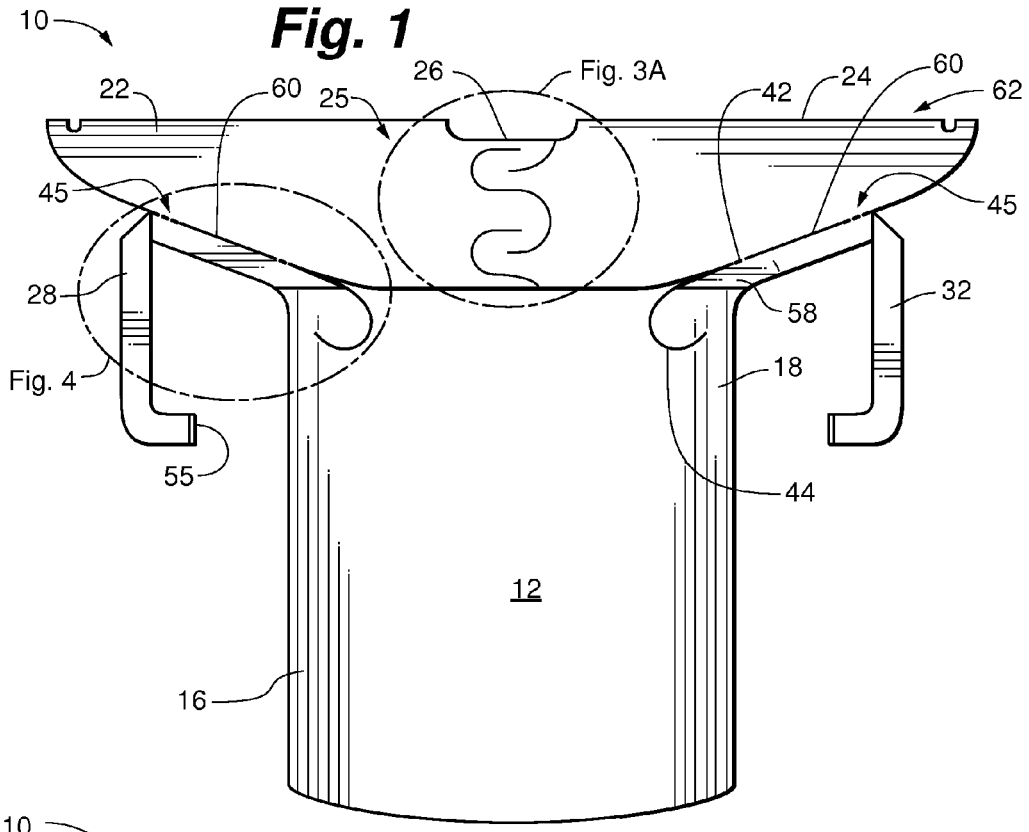
Fig. 1
10
22
60
25
26
Fig. 3A
42
24
60
62
45
45
28
58
32
Fig. 4
18
55
44
12
16
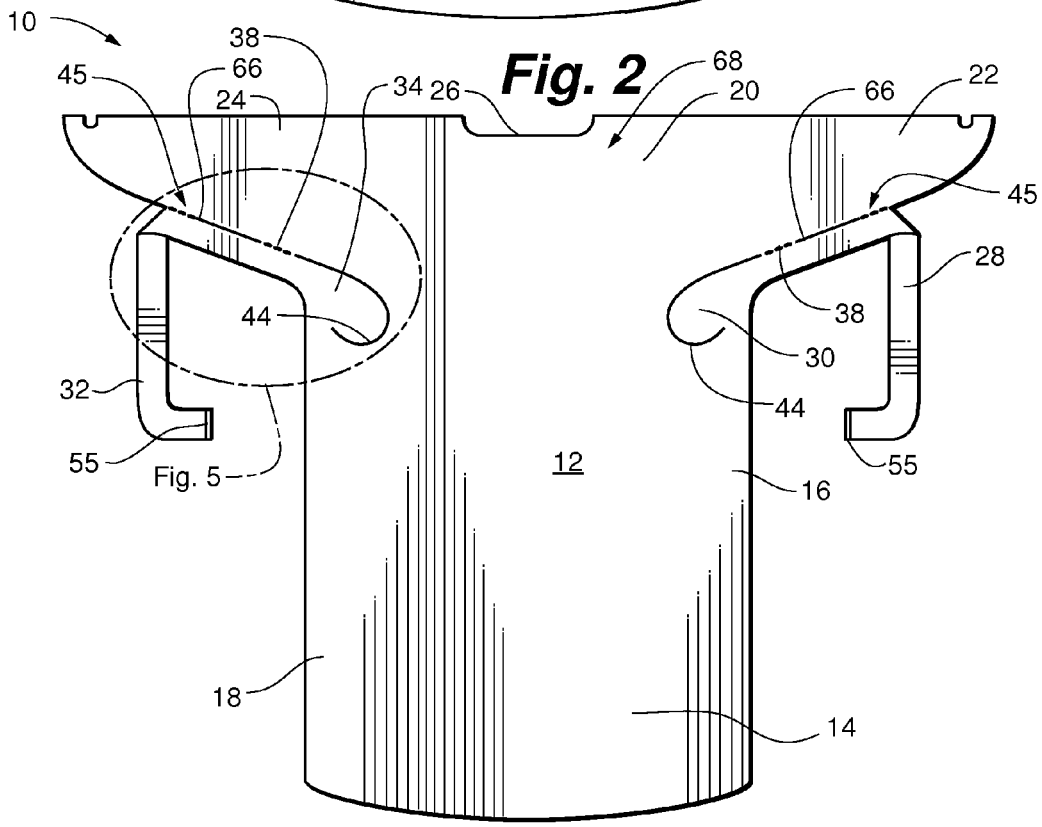
Fig. 2
10
38
45
66
24
34
26
68
20
66
22
45
28
44
38
30
32
44
55
Fig. 5
12
55
16
18
14

ADJUSTABLY SIZED MEDICAL GOWN

CROSS-REFERENCE TO RELATED APPLICATION

The present disclosure is related to a co-owned U.S. nonprovisional patent application filed on even day herewith, entitled MEDICAL GOWN WITH ADJUSTABLE TIE STRAPS having named inventors George Daniel Reese and Donna L. Reese, referred to herein as "Related Application," the entirety of which is incorporated herein by reference.

BACKGROUND

Technical Field

The present disclosure relates generally to medical gowns and, in particular, to a medical gown adjustable in size.

Background

Medical gowns for use by various health care workers, as well as by hospital visitors, are well-known in the art. Such protective wear may be designed to provide various levels of protection depending on the particular use and potential contaminants that the health care worker may be exposed to. At the least, a medical gown should shield the wearer's clothes and skin from direct contact with any bodily fluids or medical waste that may be contaminated with germs or viruses. Preferably, the medical gown is appropriately fitted on the wearer for use, such that no portions of the gown may loosely drape or inadvertently contact contaminated surfaces or substances. While medical gowns may be manufactured in different sizes to accommodate healthcare workers of various stature, finding an appropriate fit may be difficult for some healthcare workers. Furthermore, donning time as well as convenience is important, as it is undesirable to require a healthcare worker to waste time trying on different sized medical gowns to find the appropriate fit.

A need exists, therefore, for medical gowns that are adjustable in size to accommodate health care workers of varying stature. A need also exists for a medical gown that is quickly and easily donned while adjustably sized to accommodate healthcare workers of various stature.

SUMMARY

Features of the disclosure will become apparent from the following detailed description considered in conjunction with the accompanying drawings. It is to be understood, however, that the drawings are designed as an illustration only and not as a definition of the limits of this disclosure.

The present disclosure is directed to a medical gown that is adjustable in size. The present disclosure is also directed to a medical gown that is easily and quickly donned while adjustably sized to accommodate healthcare workers of various stature.

In one aspect, the present disclosure is directed to a medical gown including a torso portion and an upper portion extending upward from the torso portion. The upper portion includes a left arm member and a right arm member for covering a left and right arm, respectively, of a wearer of the medical gown, and an upper torso section connecting the left arm member to the right arm member. The upper torso section further includes an opening for fitting a wearer's head therethrough.

The upper torso section further includes at least one self-adjusting strap for expanding the upper torso section in use beyond a nominal girth thereof.

In one aspect, the at least one self-adjusting strap is formed from a pattern of perforations in the upper torso section. A portion of the medical gown forming the at least one self-adjusting strap may at least partially break away when in use along the perforations to allow expansion of the upper torso section, while remaining attached to the medical gown for securing the medical gown on the wearer during expansion of the upper torso section.

In another aspect, the nominal girth of the medical gown is maintained when donned by a wearer having an upper torso girth less than the nominal girth, the at least one self-adjusting strap remaining intact with substantially no breaking away along the perforations. During use by a wearer requiring an upper torso girth greater than the nominal girth, the at least one self-adjusting strap at least partially breaks away along the perforations to allow expansion of the upper torso section as needed to fit the wearer.

In a further aspect, the pattern of perforations includes perforations arranged to form at least one arc for breaking away to form an opening that allows expansion beyond the nominal girth of the upper torso section.

In yet a further aspect, the pattern of perforations includes perforations aligned in an S-shape. Preferably, neither end of the S-shape extends to a corresponding upper or lower edge of the upper torso section.

In still another aspect, the pattern of perforations further includes a curved segment around an end of the S-shape. The curved segment and the end of the S-shape define the portion of the medical gown forming the at least one self-adjusting strap. The at least one self-adjusting strap is configured to at least partially break away along the perforations and elongate across the upper torso section when in use by a wearer having an upper torso girth greater than the nominal girth.

One end of the curved segment of perforations may extend to one of a top edge and a bottom edge of the upper torso section.

In one aspect, the upper torso section includes a front side and a back side, wherein the at least one self-adjusting strap is formed on the back side of the upper torso section.

In aspects, the at least one self-adjusting strap comprises an upper strap and a lower strap.

In yet another aspect, the torso portion includes a front portion and a left and a right side portion connected on opposing sides thereto. The medical gown further includes a tie member extending on one end from one of the left and right side portions. A section of the tie member is folded over lengthwise. A portion of the folded section is detachably connected to one of the left and right arm members that is proximate the one end, the tie member operable upon being detached from the one of the left and right arm members by a wearer to unfold and elongate for tying around a waist of the wearer.

In additional aspects, the tie member is a first tie member extending from the left side portion proximate the left arm member. The first tie member is detachably connected to the left arm member. The medical gown further includes a second tie member extending from the right side portion proximate the right arm member. A section of the second tie member is folded over lengthwise, a portion of the folded section of the second tie member being detachably connected to the right arm member. The second tie member is operable upon being detached from the right arm member by the wearer to unfold and elongate for tying around the wearer.

In still another aspect, each of the first tie member and the second tie member is operable to extend around each of the left and the right side portions and to tie together to form a closure around the wearer. A size of the closure is adjustable by unfolding one or both of the first tie member and the second tie member being tied together.

In another aspect, each of the first tie member and the second tie member is sufficiently long, once unfolded, to extend around each of the left and right side portions, respectively, to the back of the medical gown, and to further extend around each of the right and left side portions, respectively, to tie together in the front of the gown.

In aspects, the detachably connected portion is formed from a perforated section of material connecting the one of the left and the right arm members to the tie member.

The detachably connected portion may be formed from one of a weak seam, an adhesive, and loose stitches connecting the one of the left and the right arm members to the tie member.

In additional aspects, the tie member may include a first section and a second section, which are bonded along one end to form a folded edge. The tie member is lengthwise folded and unfolded along the folded edge.

The medical gown in various aspects may be formed of a material comprising polyethylene coated spunbond polypropylene.

The medical gown in various additional aspects may be formed of a material and of a construction to provide fluid resistant protection to a wearer of the medical gown.

The material may further include an antimicrobial agent.

In yet further aspects, each of the right and left arm members of the medical gown may include a full-length sleeve for fitting a wearer's arm therethrough and comprising a first opening for at least a portion of a wearer's hand and a second opening for fitting a wearer's thumb therethrough.

In addition to the above aspects of the present disclosure, additional aspects, objects, features and advantages will be apparent from the embodiments presented in the following description and in connection with the accompanying drawings.

BRIEF DESCRIPTION OF THE DRAWINGS

The drawings constitute a part of this disclosure and include examples, which may be implemented in various forms. It is to be understood that in some instances, various aspects of the disclosure may be shown exaggerated or enlarged to facilitate understanding. The teaching of the disclosure can be readily understood by considering the detailed description in conjunction with the accompanying drawings, which are briefly described below.

FIG. 1 is a pictorial representation of a back view of an embodiment of a medical gown of the present disclosure.

FIG. 2 is a pictorial representation of a front view of the embodiment of the medical gown of FIG. 1.

Figure 3A:
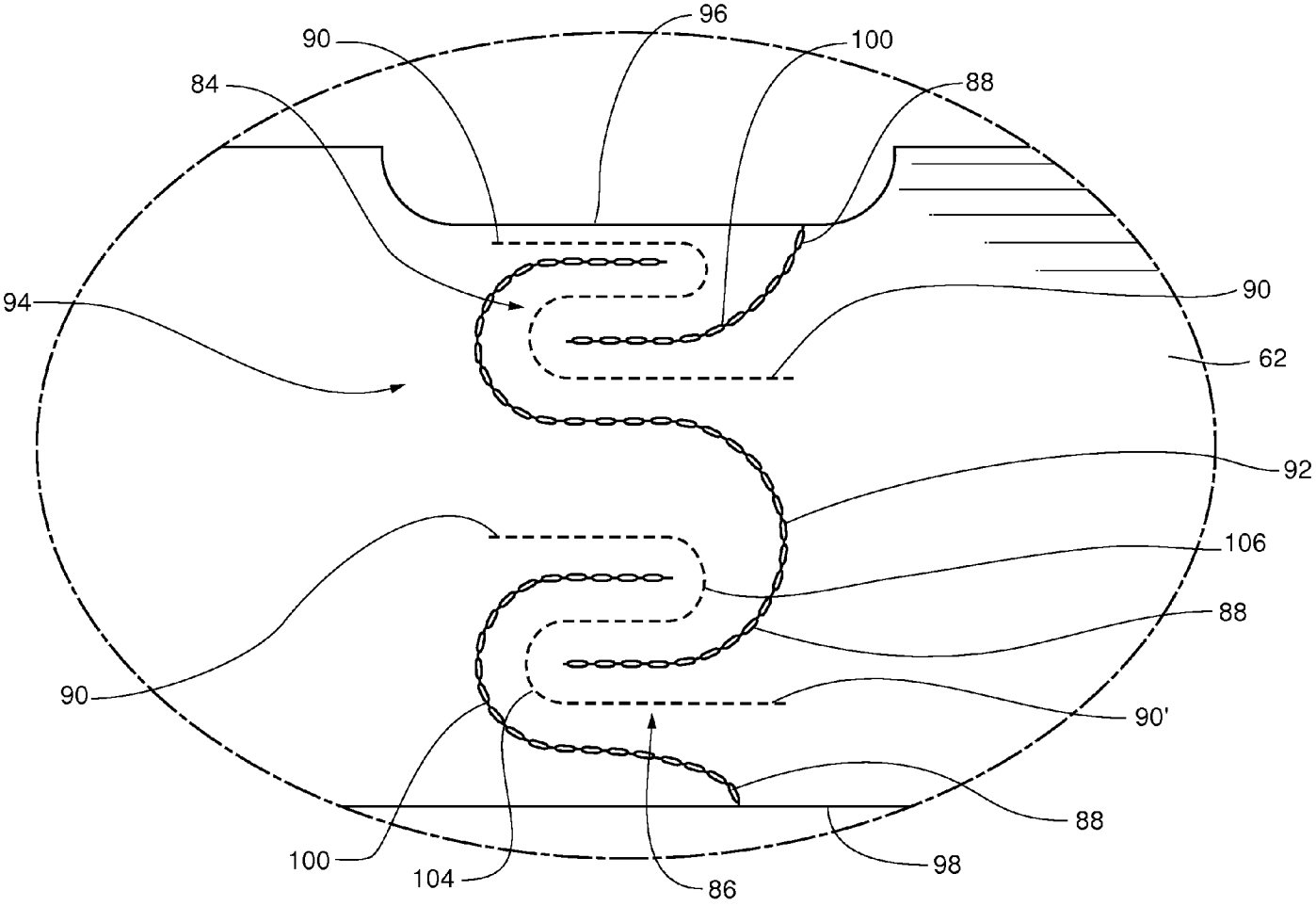
FIG. 3A is an enlarged view of an encircled area of FIG. 1.

The various aspects of the present disclosure mentioned above are described in further detail with reference to the aforementioned figures and the following detailed description of exemplary embodiments.

DETAILED DESCRIPTION

Particular illustrative embodiments of the present disclosure are described hereinbelow with reference to the accompanying drawings; however, the disclosed embodiments are merely examples of the disclosure, which may be embodied in various forms. It should be apparent to those skilled in the art that the described embodiments provided herein are illustrative only and not limiting, having been presented by way of example only. All features disclosed in this description may be replaced by alternative features serving the same or similar purpose, unless expressly stated otherwise. Therefore, numerous other embodiments of the modifications thereof are contemplated as falling within the scope of the present disclosure of a medical gown as defined herein and equivalents thereto. Well-known functions or constructions and repetitive matter are not described in detail to avoid obscuring the present disclosure in unnecessary or redundant detail. Therefore, specific structural and functional details disclosed herein are not to be interpreted as limiting. In this description, as well as in the drawings, like-referenced numbers represent elements which may perform the same, similar, or equivalent functions.

Throughout the description, where items are described as having, including, or comprising one or more specific components or features, or where methods are described as having, including, or comprising one or more specific steps, it is contemplated that, additionally, there are items of the present disclosure that consist essentially of, or consist of, the one or more recited components or features, and that there are methods according to the present disclosure that consist essentially of, or consist of, the one or more recited processing steps.

The present disclosure is directed to a medical gown that may reduce the risk of exposure to healthcare workers of contaminants. The present disclosure is also directed to a medical gown that minimizes the risk of exposure to healthcare workers of contaminants while also being adjustable in size to accommodate health care workers of various stature. The embodiments described herein are directed to improvements to a type of a medical gown which may be referred to as a "personal protection gown." Although the medical gown of the embodiments shown does not fully cover a wearer's back, as one of ordinary skill in the art will recognize, the present disclosure is not, however, limited thereto. Accordingly, the gown of the present disclosure may be constructed with a full back layer and other features, for example, to comply with different levels of AAMI ("Association for the Advancement of Medical Instrumentation") protection. In embodiments, the medical gown of the present disclosure may include gowns of varying lengths, as well as gowns that fully cover the back as well as the front of a wearer, and, optionally, the head. In addition, while the embodiments described are directed to a gown that is donned over the wearer's head, the scope of the claims is not limited to the particular configuration that is described in the embodiments. For example, the medical gown of the present disclosure may include, but is not limited to, personal protection gowns, surgical gowns, isolation gowns, and so on, including gowns formed of the appropriate materials and of the appropriate construction as to provide the desired level of fluid resistant and/or fluid impervious protection to the wearer. The medical gown of the present disclosure may also be formed of a material that comprises antitoxins and/or antimicrobials.

"Nominal" is used herein to describe a "nominal size" or "nominal girth," which refer to a size of the medical gown or a girth (circumferential measurement) around, for example, a wearer's chest, as it is packaged, having not been stretched or enlarged as a result of use by a wearer of a larger size than the nominal size. The nominal size and nominal girth of a medical gown of the present disclosure may correspond to an industry standard's determination of a size and girth of an "average" person of "medium" size, or of a person of a "large" size, an "extra large" size, a "small" size and so on.

In embodiments, the nominal size and nominal girth of a medical gown of the present disclosure may correspond to an industry standard "medium" size, for example, suitable to be worn by persons of average size or smaller without requiring stretching or enlarging. The medical gown of the present disclosure can be adjustably sized and enlarged to also accommodate persons of larger stature for a "one size fits all" gown.

"Ties," "tie straps," and "tie members" are used interchangeably herein to refer to a long narrow strip of material used for binding or securing the medical gown on a wearer by tying.

Referring to FIGS. 1 and 2, embodiments of a medical gown 10 of the present disclosure include a torso portion 12. The torso portion 12 may include a front portion 14 and a left 16 and a right side portion 18 connected to opposing sides of the front portion 14. The medical gown 10 also includes an upper portion 20, which extends upward from the torso portion 12 to cover the shoulders and arms of a wearer of the gown. In embodiments, the upper portion 20 includes a left arm member 22 and a right arm member 24 for covering a left and right arm, respectively, of a wearer of the medical gown. In embodiments, the left and right arm members are full length sleeves that extend over the arms and may also extend over substantial portions of the hands of a wearer. The upper portion 20 of the medical gown 10 also includes a back side 62 and a front side 68.

Referring to FIG. 1, the upper portion 20 of the medical gown 10 further includes an upper torso section 25 connecting the left arm member 22 and the right arm member 24, and an opening 26 appropriately sized and positioned for fitting a wearer's head therethrough. Formed in the upper torso section 25 are one or more self-adjusting straps 84, 86 which are further described below in reference to FIGS. 3A to 3D. The self-adjusting strap(s) allow the upper torso section 25 to expand when in use by a wearer who requires a larger sized gown in the shoulder and/or back region than the nominal size otherwise provided.

In the embodiment of FIGS. 3A-3D, two self-adjusting strap(s), an upper strap 84 and a lower strap 86, are formed on the back side 62 of the upper torso section 25. When the medical gown is used by a wearer who requires a greater girth across the upper torso section 25 than the nominal girth the medical gown provides, portions of one or more of the self-adjusting straps begin releasing from the torso section 25 as a result of stress placed across the gown in that region by the wearer, thereby expanding the upper torso section 25 to provide a greater girth than the nominal girth. The upper torso section 25 may begin to expand during use as the wearer dons the medical gown and/or after donning the gown while attending to normal activities. Depending on the particular measurements of the wearer, one or both of the upper strap 84 and the lower strap 86 may be at least partially released and elongated during use as needed.

While the self-adjusting straps shown in FIGS. 3A to 3D are formed in the upper torso section 25 corresponding to a central region of a wearer's back, in embodiments, the self-adjusting straps of the present disclosure may alternatively or additionally be placed off-center, for example, near the shoulder blades of a wearer, and/or across a portion of the front of the upper torso portion, and/or along the sides of the medical gown 10 for expanding the girth of the upper torso section 25 during use.

Figure 3B:
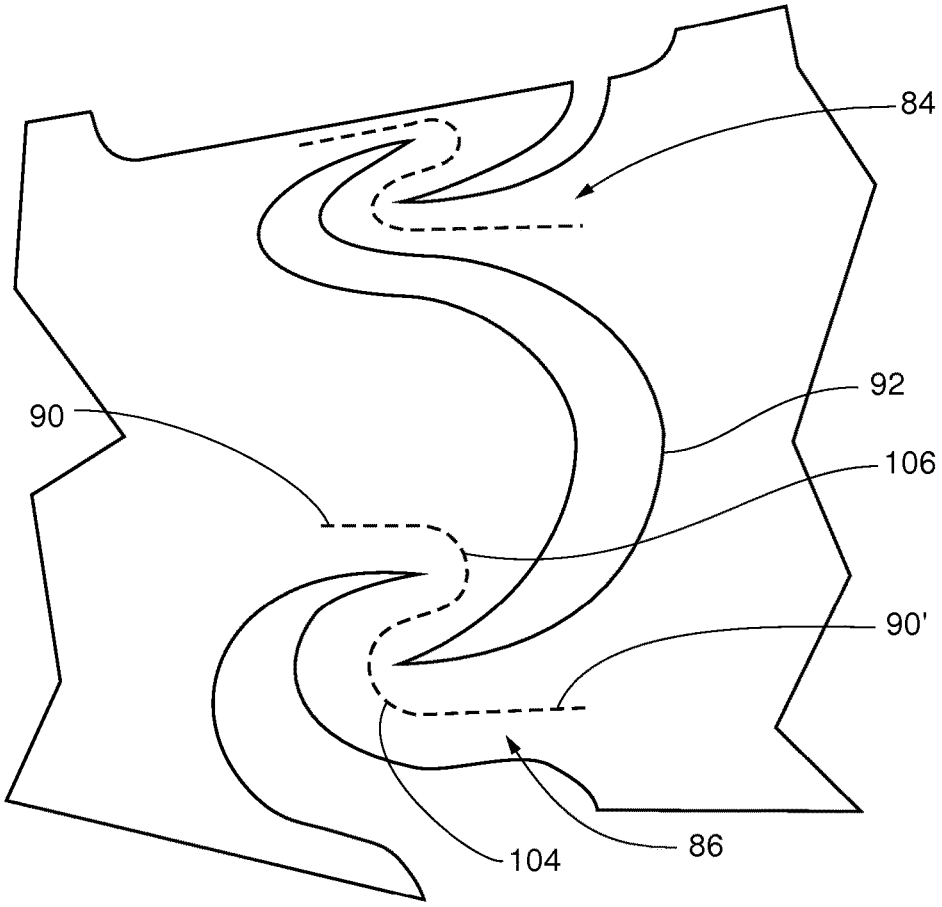
FIG. 3B is a pictorial representation of FIG. 3A when the gown is in use by a wearer requiring a fit across the back greater than the nominal fit shown in FIG. 3A.
Figure 3C:
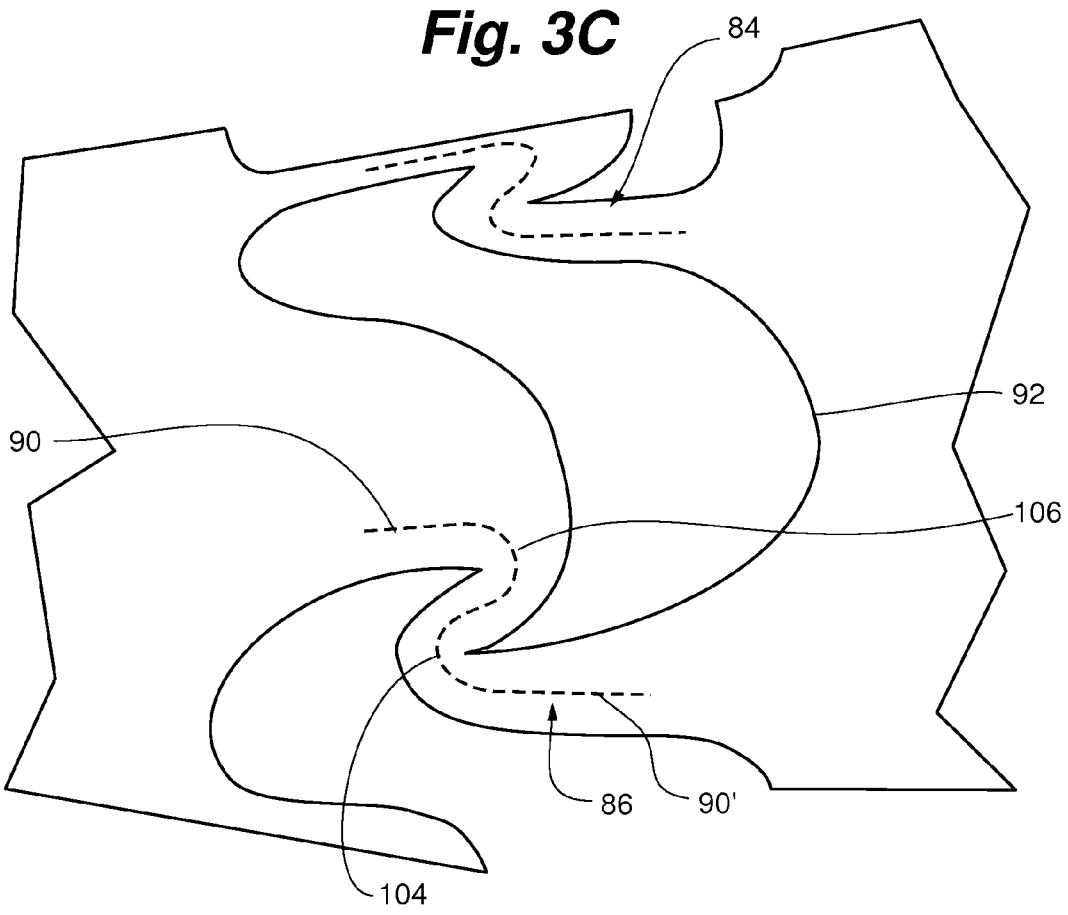
FIG. 3C is another pictorial representation of FIG. 3A when the gown is in use by a wearer requiring a fit across the back greater than the nominal fit shown in FIG. 3A.

Referring to FIG. 3A, in embodiments, the self-adjusting straps 84, 86 are formed from a pattern of perforations 88. When the gown is used by a person of a smaller size than the nominal size of the gown, the self-adjusting straps remain intact as shown in FIG. 3A, with substantially no breaking away along the perforations 88, so that the nominal girth of the upper torso section 25 is maintained. Referring also to FIGS. 3B and 3C, during use by a person requiring greater than the nominal girth provided by the upper torso section 25, a portion of the medical gown forming strap 86, for example, at least partially breaks away along the perforations 88 to release the strap 86 for expansion.

While the self-adjusting straps 84, 86 are releasable from the adjacent material of the gown to which they are nominally connected along the perforations 88, the straps remain connected at their ends 90 to the upper torso section 25 to continue to secure the medical gown on a wearer during use.

In embodiments, the perforations 88 may be in the form of an arc 92 or C-shape, which may be approximately centered in the back 62 of the upper torso section 25. Breaking away of the perforations forming the arc 92 provides an opening that allows expansion beyond the nominal girth of the upper torso section, and defines upper strap 84 and lower strap 86.

In the embodiments of FIGS. 3A-3D, the arc 92 may be part of an S-shaped pattern 94 that extends from proximate the neck opening 26 to a bottom portion of the upper torso section 25, neither end of the S extending to a corresponding upper 96 or lower edge 98 of the medical gown 10. A curved segment 100 of perforations is juxtaposed around each of a top and bottom portion of the perforations 88 forming the S 94, such that curved strips of material of the gown are formed between the perforations 88. Each of the curved segments 100 has one end extending to the corresponding proximate edge 96, 98.

Figure 3D:
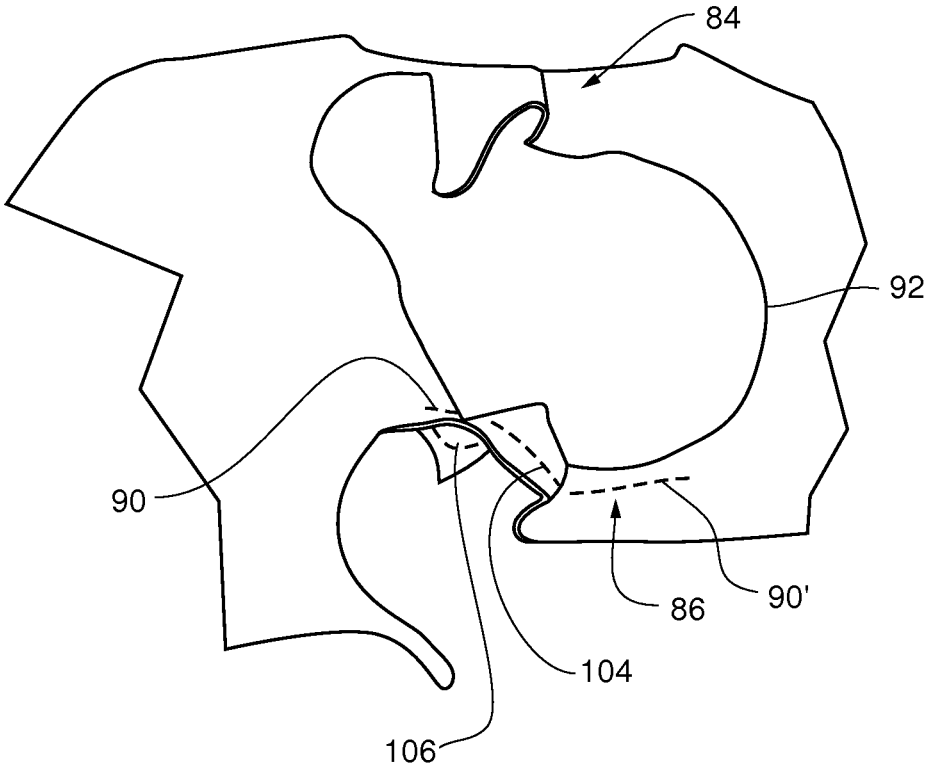
FIG. 3D is another pictorial representation of FIG. 3A when the gown is in use by a wearer requiring a fit across the back greater than the nominal fit shown in FIG. 3A.

Referring to FIG. 3B, with sufficient stress during use by a wearer requiring a larger fit than nominally provided in the upper torso of the gown, at least a portion of the perforations 88 defining the self-adjusting straps break away to allow expansion. Referring also to FIG. 3C and FIG. 3D, with sufficient stress, the perforations 88 defining the self-adjusting straps 84 and 86 continue to break away, as the curved strips are straightened and elongated across the upper torso section to allow further expansion as needed. Comparing FIGS. 3C and 3D to FIGS. 3B and 3A, for example, as the curved strips forming the self-adjusting straps 84,86 are released from the surrounding material of the gown and straightened, the bended portion 106 that is nominally to the right of the bend 104, is extended and pulled finally to the left of the bend 104 in the expanded position shown in FIG. 3D.

The self-adjusting straps of the present disclosure provide adjustability in size of the medical gown as the gown is donned and used. No adjustments are required by the wearer. On the contrary, the perforations break on their own as the gown is normally used.

In additional embodiment, the medical gown 10 may include additional adjustability in size by providing tie straps for tying around the waist of a user that are adjustable in length. Referring again to FIGS. 1 and 2, the medical gown 10 may further include a tie member 28 that extends on one end 30 from, and which may be integral with, the left side portion 16. The medical gown 10 may further include a tie member 32 that extends on one end 34 from, and which may be integral with, the right side portion 18.

Figure 4:
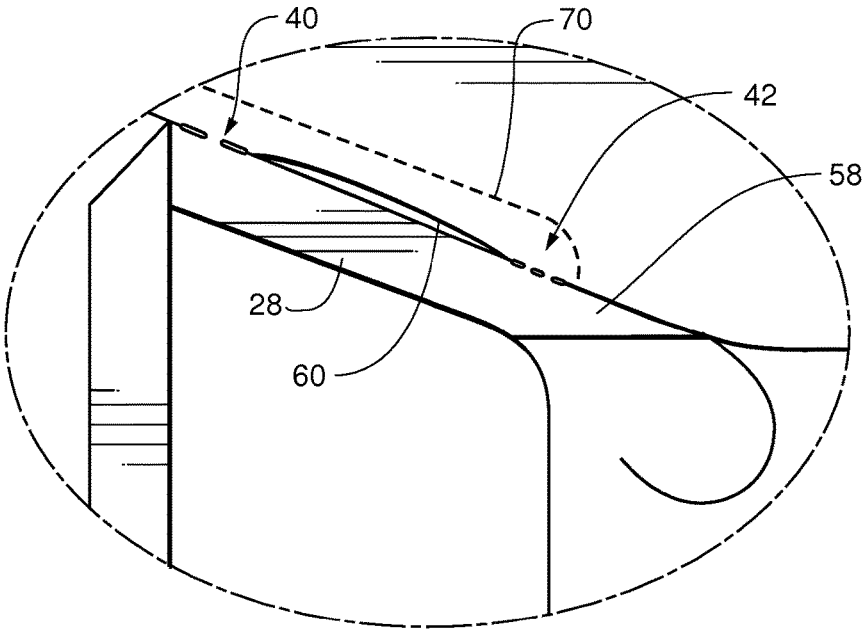
FIG. 4 is an enlarged view of another encircled area of FIG. 1.
Figure 5:
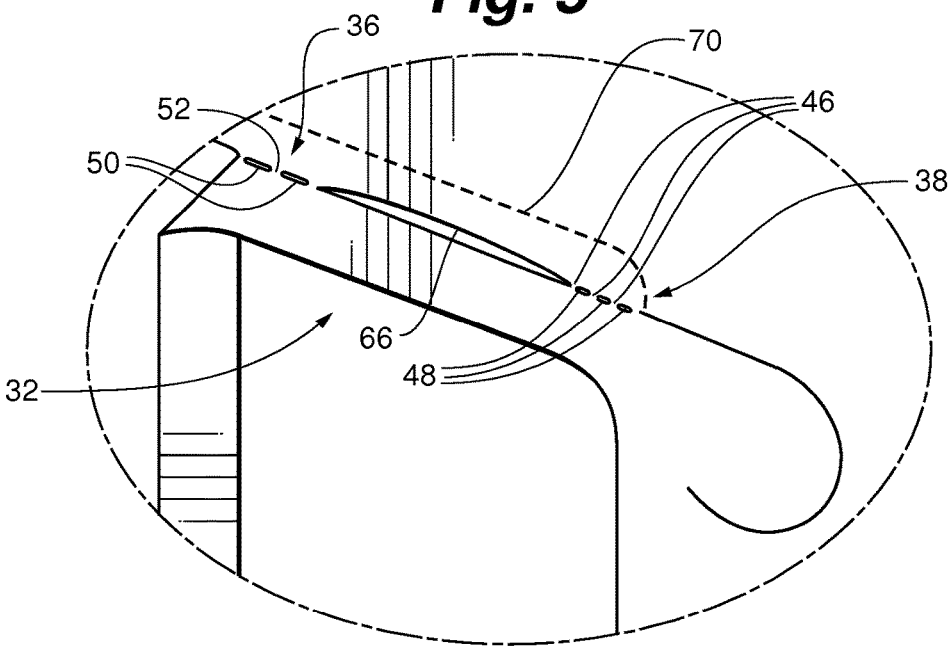
FIG. 5 is an enlarged view of the encircled area of FIG. 2.

In embodiments, each tie member is detachably connected to its respective proximate arm member. Referring to FIGS. 4 and 5 as well as to FIGS. 1 and 2, embodiments of the medical gown of the present disclosure are configured to allow a wearer to don the gown without the tie straps dangling on the floor. In addition, by connecting tie members 28 and 32 to the arm members 22 and 24, respectively, the wearer does not have to struggle to reach and find them each time a gown is used, as is the case with other gowns which have straps that loosely dangle. On the contrary, each tie member 28 and 32 is reliably fixed on at least one portion of the respective arm member 22, 24 that is easy to access for detachment by the wearer. This allows any wearer to quickly and easily don the gown, access the straps, and secure them around the wearer's waste by tying.

Referring still to FIGS. 1-2 and 4-5, tie members 28 and 32 may be detachably connected at one or more portions to the arm members 22, 24. At least one portion 45 that is easily accessible by the wearer preferably stays attached after the wearer dons the gown. The wearer may then reach across with one (left/right) hand to the opposite (right/left) arm to tug on and remove the connected portion 45 from each arm member 22, 24. Once the wearer disconnects the tie straps 28, 32 from the respective arm members 22, 24, the wearer may extend each tie member 28, 32 around each of the left 16 and the right side portions 18, respectively, and tie them together to form a closure around the wearer for securing the gown.

The tie members are preferably sufficiently long, once unfolded, to extend around each of the left and right side portions, respectively, to the back of the medical gown, and to further extend back around each of the right and left side portions, respectively, to the front of the gown for tying. This affords great flexibility to the user in adjusting the fit of the gown, and in adjusting the amount of excess strap length after tying.

In embodiments, the detachably connected portions 45 are formed from a perforated section of material connecting the tie member to the respective (proximate) arm member. In particular embodiments described below, detachably connected portions 45 include front 36 and back portions 40, which, as shown in FIGS. 4-5, may each include perforated sections.

In embodiments, the detachably connected portions 45 may be formed from a weak seam, an adhesive, or loose stitches connecting the tie member to the respective (proximate) arm member.

Referring to FIGS. 1-2 and 3-4, additional detachably connected portions 38, 42 located closer to the front portion 14 than portions 45, may weakly connect the tie members 28, 32 to arm members 22, 24. In embodiments, the additional portions 38, 42 are configured to break away easily as the wearer dons the gown 10, leaving only connected portions 45 intact. As described supra, the wearer then tugs on the straps at portions 45 to detach them from the arm members.

Referring again to FIGS. 4-5, the detachable portions 38, 42 may represent front and back detachably connected sections, respectively, each of which may have a differently configured perforated pattern or otherwise be configured to break-away with more or less ease. In place of separate front and back portions 38, 42, in different embodiments, a single perforated or otherwise weakly connected section connects the tie strap to a single layer of material extending from each sleeve 22, 24.

As shown in FIG. 4 and FIG. 5, connected portions 38, 42 may include one or more small continuous points, or tacks 46, between the tie member and proximate arm member, separated by perforations 48, or discontinuous edges or breaks between the tie member and proximate arm members, that are sufficiently large to allow the tacks 46 to easily break upon the wearer donning the gown. In embodiments of the medical gown 10 of the present disclosure, portions 45 may provide a stronger connectivity, requiring the wearer to tug on each tie member to disconnect it from the proximate arm member after donning the gown. For example, the perforated sections 50 may be smaller than adjacent connecting sections 52.

The medical gown 10 of the present disclosure may also include cut-outs to aid in fitting the gown around the wearer. For example, curved cut-outs 44 may be provided in the torso portion 12 proximate the ends 30, 34 of the tie members. When the wearer extends the tie members back around the side portions 16, 18, the side portions separate from the arm members along cut-outs 44, so that the side portions 16, 18 can wrap around the sides and back of a wearer.

Although not shown, the side portions may be weakly tacked to the front portion 14 along the cut-outs 44. For example, a few, small, scattered points of continuity between the front portion 14 and proximate side portion 16, 18 may be provided along the cut-out 44. The side portions 16, 18 easily break away along the cut-outs 44 upon donning the gown 10 and/or when the wearer extends the tie members back around the side portions 16, 18 for tying.

Referring still to FIGS. 1-2 and 4-5, in embodiments, the arm members 22, 24 are formed by joining a portion of a bottom edge 60, 66 of each of the back side 62 and the front side 68 to form an enclosure for covering a wearer's arms. The seam for joining the arm members may be formed by any appropriate means in the art, including heat sealing, stitching, adhesives, and so on. As shown in FIGS. 4 and 5, in embodiments, the seams 70 may be formed on the outer surfaces of the gown, such that the bottom edge 60, 66 of each of the back side 62 and the front side 68 remain exposed for attaching to the tie members 28, 32.

Figure 6A:
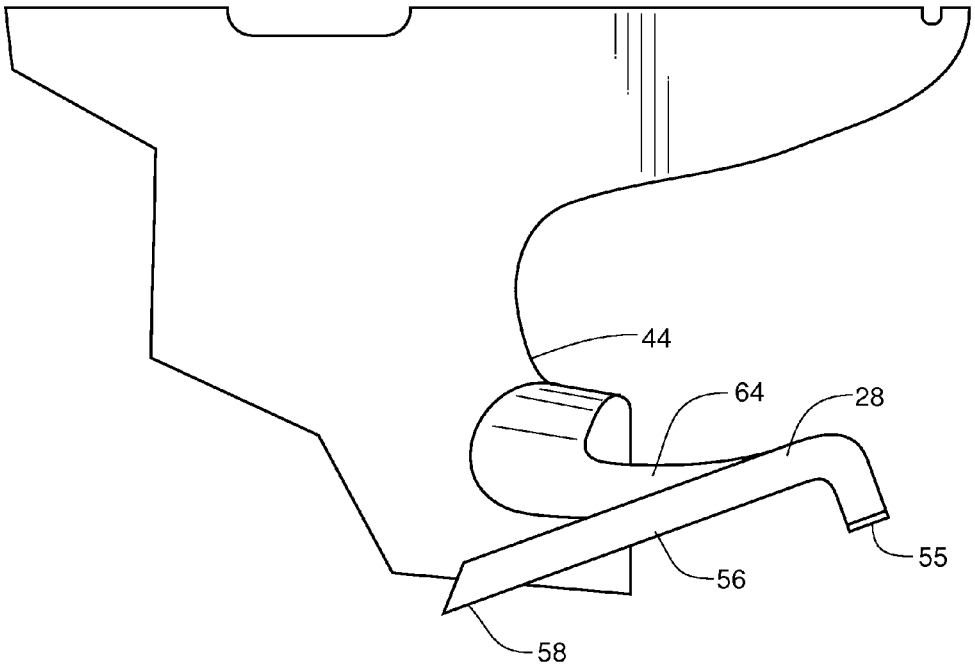
FIG. 6A is a pictorial representation of a front view of an embodiment of the medical gown of FIG. 1, with the left strap detached from the sleeve of the gown.
Figure 6B:
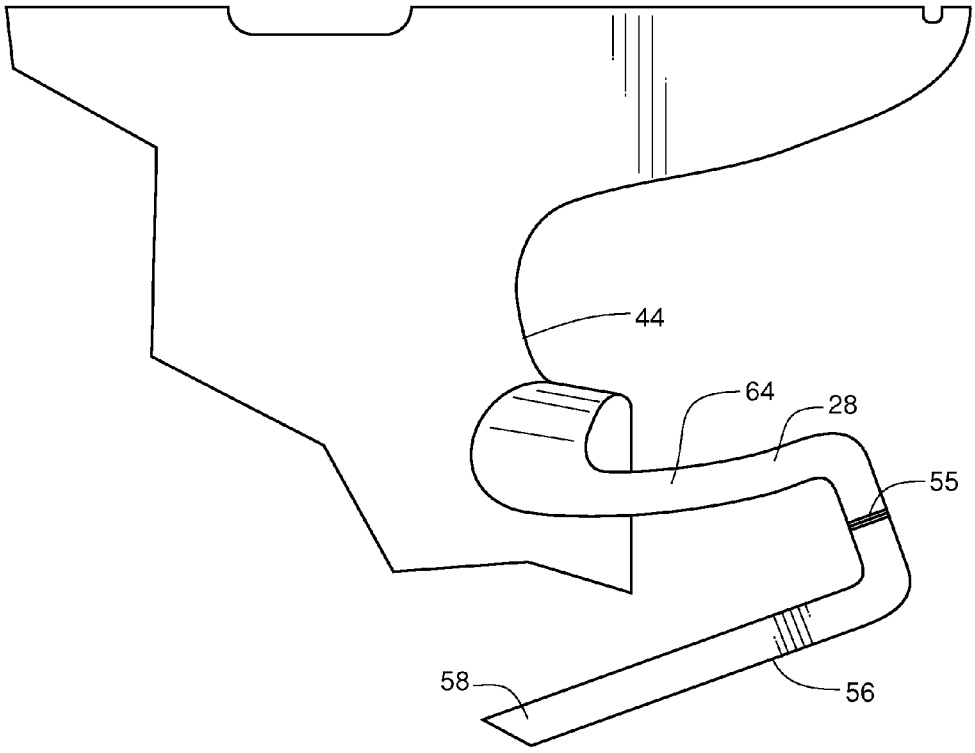
FIG. 6B is a pictorial representation of an embodiment of the medical gown of FIG. 6A, with the left strap detached and unfolded for elongation.
Figure 7A:
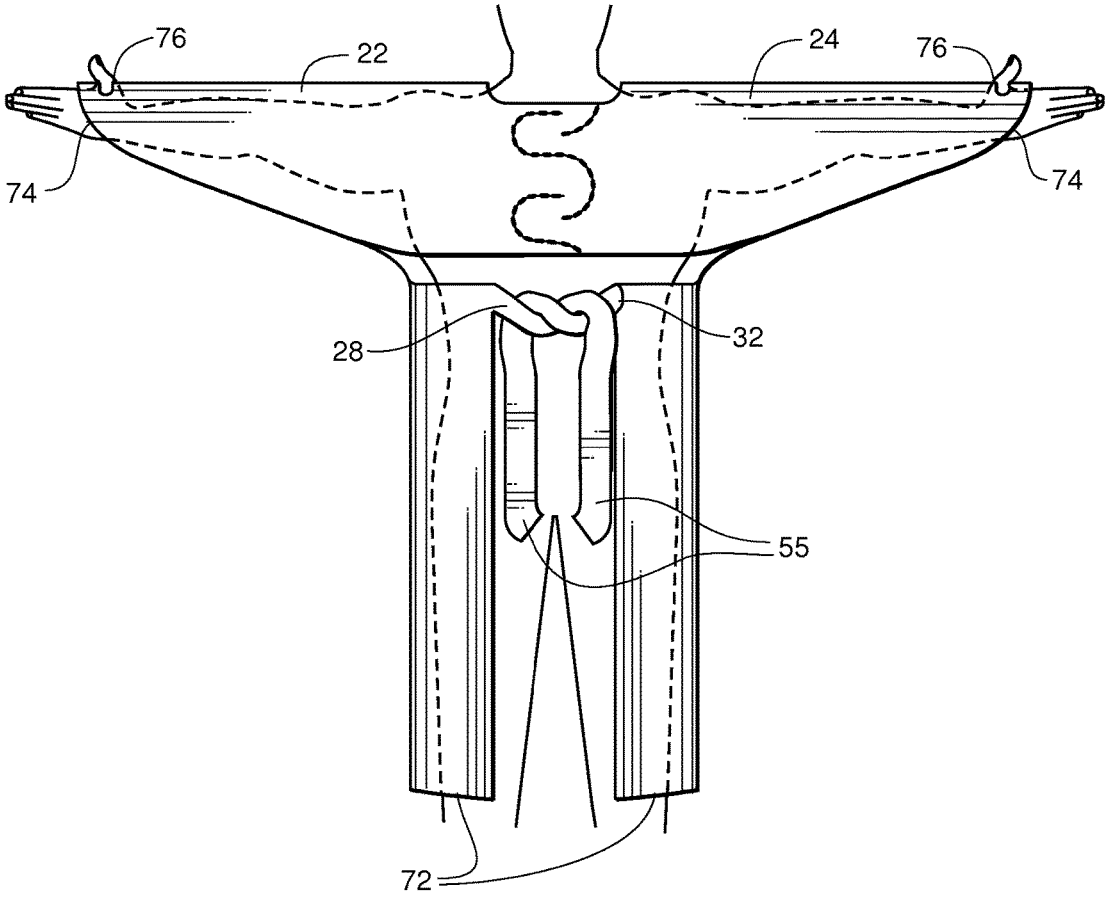
FIG. 7A is a pictorial representation of a back view of an embodiment of the medical gown of FIG. 1 closed and tied around a wearer in a first configuration.
Figure 7B:
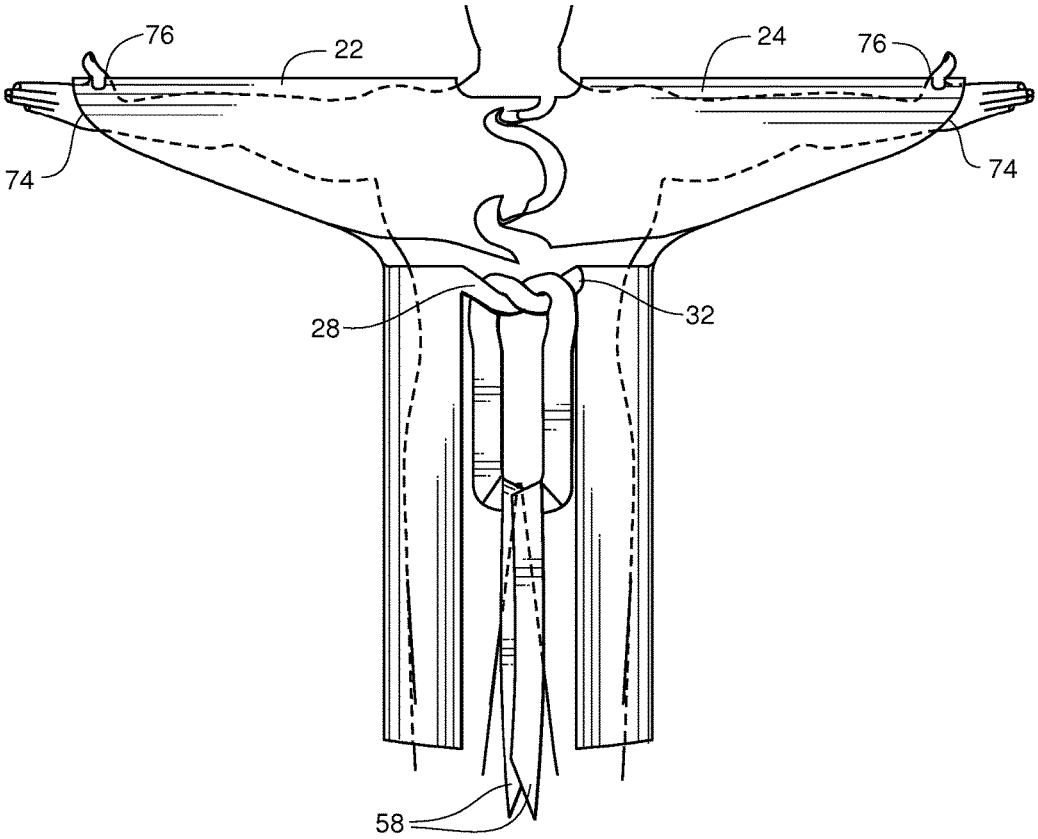
FIG. 7B is a pictorial representation of a back view of an embodiment of the medical gown of FIG. 1 closed and tied around a wearer in a second configuration.

Referring also to FIGS. 6A and 6B, in embodiments, each tie member 28, 32 includes a folded edge 55 about which a lengthwise section 56 of the tie member is folded. In embodiments, section 56 and at least one section 64 onto which section 56 is folded are detachably connected to arm members 22, 24, at least at one portion 45 as described above. Once the tie members 28, 32 are detached by the wearer, one or more folded sections may be unfolded and elongated for tying around a waist of the wearer. Optionally, as shown in FIG. 7A, for example, if the wearer is of small stature, the tie members may be detached from the arm members, and remain folded around folded edge 55 while extended around the wearer and tied together to form a smaller closure. FIG. 7B shows the tie members unfolded and tied, in one configuration, in a double knot, before being tightened around the user. As should be apparent from FIG. 7B, when the tie members are extended in their unfolded state, the size of the closure is adjustable to fit a person of larger stature than when used in the folded state of FIG. 7A. By unfolding one or more sections of one or both of the left tie member 28 and the right tie member 32 for tying together around the waist of the wearer, the size of the closure is adjustable. In addition, preferably in both configurations of FIGS. 7A and 7B, when the length of the tie members is appropriately adjusted to the wearer's stature, the tie members will not dangle onto the floor.

In embodiments, the tie members are sufficiently long, once unfolded and extended, to extend around the left and right sides, respectively, to the back of the medical gown, and to further extend around the right and left sides, respectively, back to the front of the gown. In this configuration, the user can advantageously tie the straps together in the front of the medical gown.

In embodiments, a medical gown may also include a double or multiple folded tie member detachably connected proximate either a left or right arm member in accordance with the present disclosure. Once unfolded, the tie member is long enough to extend entirely around the gown for tying its loose end 58 back onto itself, for example, back onto the end 30, 34 that extends from the side portion 16, 18. Optionally, a loop (not shown) may be provided on the front portion 12, around which the loose end 58 may be tied.

In some embodiments, each of the folded sections 56 and 64 is separately attached to the bottom edge 60, 66, of the back 62 and front sides 68, respectively, of the tie members. For example, referring to FIGS. 1 and 4, an end 58 of the tie member 28, 32 may be detachably connected at a portion 42 along the bottom edge 60 of a back side 62 of each arm member 22, 24. In embodiments, at least a portion 40 of the folded length 56 is detachably connected, for example, along the bottom edge 60 and preferably remains connected, upon a wearer donning the gown 10, requiring the wearer to tug on the tie member for detaching and extending around one's waist to form a closure, as described above.

Referring to FIGS. 2 and 5-6B, at least a portion 36 of section 64 of each of the tie members is detachably connected, for example, along a bottom edge 66 of a front side 68 of each arm member 22, 24 and preferably remains connected, upon a wearer donning the gown 10, requiring the wearer to tug on the tie member for detaching and extending around one's waist to form a closure, as described above. In embodiments, the section 64 of each tie member may be detachably connected at additional portions 38 along the bottom edge 66.

In some embodiments, the sections 56 and 64 of each tie member are bonded together at one end to form the folded edge 55. Accordingly, sections 56 and 64 may be formed from separate strips of material.

In embodiments, sections 56 and 64 are bonded together with an adhesive.

In embodiments of a medical gown of the present disclosure, referring to FIG. 7A, for example, no portion of either of the detachably connected tie members 28, 32 on the medical gown donned by a user, before being detached from the respective arm members 22, 24, hangs below a bottom edge 72 of the torso portion 12.

In further embodiments, each of the right 22 and left arm members 24 is a full-length sleeve for fitting a wearer's arm therethrough, and includes an opening 74 for at least a portion of a wearer's hand. Preferably, a second opening 76 is also provided for fitting a wearer's thumb therethrough.

In other embodiments, an elasticized cuff around the wrist area, or any other appropriate means may be employed instead of the thumb opening shown to keep the arm members and gown in place on a user.

The medical gown may be formed of any suitable material. In embodiments, the medical gown is formed of a synthetic material.

In embodiments, the material comprises polyethylene coated spunbond polypropylene.

The material, along with the construction of the gown, may provide a fluid resistant gown. Higher levels of protection may be provided as described above by appropriate choice of materials and construction.

In other embodiments, at least portions of the medical gown is formed of a natural or nonsynthetic material.

In some embodiments, the material may further include an antimicrobial or antitoxin agent.

The medical gown of the present disclosure can be manufactured using any suitable method known in the art. For example, starting with a single layer of material cut into an appropriate shape for forming the front and back of the gown and arm members, the perforations 88 formed in the upper torso section may be formed using any method known in the art before folding to create the front and back layers. The corresponding section of the material is then folded along the neck line to create the two layers that will comprise the front and back of the gown. This two layer section may then be bonded as needed (along line 70 as shown in the figures, for example) to create the arm sleeves and the attachment strap(s). Bonding of the materials can be achieved by the use of adhesives, heat and pressure, ultrasonics, or any other suitable means. In this way, portions of the folded section below the seam 70 form the extendable strap(s), which are then die cut by commercially available means such as flatbed die cutting, power knife system or similar means. Perforations may be added, in accordance with methods known in the art, along the bottom edge 60, 66 of each of the back side 62 and the front side 68 to enable easier separation of the straps for use.

While particular embodiments of the present disclosure have been particularly shown and described with reference to specific embodiments, it should be apparent to those skilled in the art that the foregoing is illustrative only and not limiting, having been presented by way of example only. It is to be understood that the disclosed embodiments are merely examples of the disclosure, which may be embodied in various forms and detail without departing from the spirit and scope of the disclosure. Therefore, specific structural and functional details disclosed herein are not to be interpreted as limiting. Numerous other embodiments of a medical gown are contemplated as falling within the scope of the accompanying claims and equivalents thereto.

What is claimed is:

1. A medical gown comprising:

a torso portion; and an upper portion extending upward from the torso portion, the upper portion comprising a left arm member and a right arm member configured to cover a left and right arm, respectively, of a wearer of the medical gown, and an upper torso section connecting the left arm member to the right arm member, the upper torso section further comprising an opening configured to fit a wearer's head therethrough;

wherein the upper torso section further comprises at least one self-adjusting strap having two ends, the at least one self-adjusting strap configured to allow expansion of the upper torso section in use beyond a nominal girth thereof and to continuously secure the medical gown to a wearer during expansion;

wherein the at least one self-adjusting strap is formed from a pattern of perforations in the upper torso section, a portion of the medical gown forming the at least one self-adjusting strap configured to at least partially break away in use along the perforations to release the at least one self-adjusting strap from adjacent portions of the medical gown for elongation of the self-adjusting strap between its two ends across the upper torso section; and wherein the pattern includes a line of perforations having two ends and arranged to form at least one arc, wherein neither end of the line of perforations extends to an upper or lower edge of the medical gown.

2. The medical gown of claim 1, wherein each of the two ends of the at least one self-adjusting strap is attached to the upper torso section, and wherein the at least one self-adjusting strap is configured to have both of its ends remain continuously attached to the upper torso section during expansion thereof.

3. The medical gown of claim 1, wherein the pattern of perforations further includes a curved segment around an end of the at least one arc, the curved segment and the at least one are defining at least a portion of the at least one self-adjusting strap.

4. The medical gown of claim 1, wherein the line of perforations is arranged in an S-shape, neither end of the S-shape extending to the upper or the lower edge of the medical gown.

5. The medical gown of claim 4, wherein a lower edge of the upper torso section corresponds to the lower edge of the medical gown and an upper edge of the upper torso section corresponds to the upper edge of the medical gown, neither end of the S-shape extending to the upper or lower edge of the upper torso section.

6. The medical gown of claim 5, wherein the pattern of perforations further includes a curved segment around an end of the S-shape, the curved segment and the end of the S-shape defining at least a portion of the at least one self-adjusting strap.

7. The medical gown of claim 6, wherein one end of the curved segment of perforations extends to one of the upper edge and the lower edge of the upper torso section.

8. The medical gown of claim 1, the upper torso section including a front side and a back side, wherein the at least one self-adjusting strap is formed on the back side of the upper torso section.

9. The medical gown of claim 8, wherein the at least one self-adjusting strap comprises an upper self-adjusting strap and a lower self-adjusting strap.

10. The medical gown of claim 1, wherein the torso portion includes a front portion and a left and a right side portion connected on opposing sides thereto, the medical gown further comprising a tie member extending on one end from one of the left and right side portions, wherein a section of the tie member is folded over lengthwise, a portion of the folded section being detachably connected to one of the left and right arm members that is proximate the one end, the tie member configured to be detached from the one of the left and right arm members and further configured to be unfolded and elongated for tying around a waist of a wearer.

11. The medical gown of claim 10, the tie member being a first tie member extending from the left side portion proximate the left arm member, the first tie member being detachably connected to the left arm member, the medical gown further comprising a second tie member extending from the right side portion proximate the right arm member, a section of the second tie member folded over lengthwise, a portion of the folded section of the second tie member being detachably connected to the right arm member, the second tie member configured to be detached from the right arm member and further configured to be unfolded and elongated for tying around a waist of a wearer.

12. The medical gown of claim 11, each of the first tie member and the second tie member operable to extend around each of the left and the right side portions and configured to tie together to form a closure around a wearer, a size of the closure being adjustable by unfolding one or both of the first tie member and the second tie member being tied together.

13. The medical gown of claim 12, wherein each of the first tie member and the second tie member is sufficiently long, once unfolded, to extend around each of the left and right side portions, respectively, to the back of the medical gown, and to further extend around each of the right and left side portions, respectively, to tie together in the front of the gown.

14. The medical gown of claim 10, wherein the detachably connected portion is formed from a perforated section of material connecting the one of the left and the right arm members to the tie member.

15. The medical gown of claim 10, wherein the detachably connected portion is formed from one of a weak seam, an adhesive, and loose stitches connecting the one of the left and the right arm members to the tie member.

16. The medical gown of claim 10, the tie member comprising a first section and a second section, the first section and the second section bonded along one end to form a folded edge, wherein the tie member is lengthwise folded and unfolded along the folded edge.

17. The medical gown of claim 1, wherein the medical gown is formed of a material and of a construction to provide fluid resistant protection to a wearer of the medical gown.

18. The medical gown of claim 17, the material further comprising an antimicrobial agent.

19. The medical gown of claim 1, each of the right and left arm members being a full-length sleeve configured to fit a wearer's arm therethrough and comprising a first opening configured to fit at least a portion of a wearer's hand and a second opening configured for fitting a wearer's thumb therethrough.

20. A medical gown comprising:

a torso portion; and an upper portion extending upward from the torso portion, the upper portion comprising a left arm member and a right arm member configured to cover a left and right arm, respectively, of a wearer of the medical gown, and an upper torso section connecting the left arm member to the right arm member, the upper torso section further comprising an opening configured to fit a wearer's head therethrough;

wherein the upper torso section further comprises at least one self-adjusting strap, the at least one self-adjusting strap configured to allow expansion of the upper torso section in use beyond a nominal girth thereof, wherein the at least one self-adjusting strap is formed from a pattern of perforations in the upper torso section, a portion of the medical gown forming the at least one self-adjusting strap configured to at least partially break away in use along the perforations to allow expansion of the upper torso section, the at least one self-adjusting strap being further configured to remain continuously attached to the medical gown and to continuously secure the medical gown on the wearer during expansion of the upper torso section, wherein the pattern of perforations includes perforations aligned in an S-shape, and wherein neither end of the S-shape extends to an upper or lower edge of the medical gown.

21. The medical gown of claim 20, wherein the pattern of perforations further includes a curved segment around an end of the S-shape, and wherein one end of the curved segment of perforations extends in the upper torso section to the upper edge of the medical gown, the curved segment and the end of the S-shape defining at least a portion of the at least one self-adjusting strap.

* * * * *